US009316956B2

(12) United States Patent
Noguchi et al.

(10) Patent No.: US 9,316,956 B2
(45) Date of Patent: Apr. 19, 2016

(54) INTERMEDIATE TRANSFER MEMBER, IMAGE-RECORDING METHOD, AND IMAGE-RECORDING APPARATUS

(71) Applicant: CANON KABUSHIKI KAISHA, Tokyo (JP)

(72) Inventors: Mitsutoshi Noguchi, Kawaguchi (JP); Yoshikazu Saito, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/686,589

(22) Filed: Apr. 14, 2015

(65) Prior Publication Data

US 2015/0301483 A1 Oct. 22, 2015

(30) Foreign Application Priority Data

Apr. 17, 2014 (JP) ..... 2014-085288

(51) Int. Cl.

*B41J 2/325* (2006.01)
*B41J 2/01* (2006.01)
*G03G 15/16* (2006.01)

(52) U.S. Cl.

CPC ..... *G03G 15/162* (2013.01); *B41J 2/01* (2013.01); *B41J 2002/012* (2013.01)

(58) Field of Classification Search

CPC ..... B41J 2/0057; B41J 2002/012; B41J 2/01; B41M 5/00

USPC ..... 347/101, 103, 104, 213; 399/101, 302, 399/308

See application file for complete search history.

(56) References Cited

U.S. PATENT DOCUMENTS

2009/0080949 A1* 3/2009 Yamanobe ..... B41J 2/01 399/308
2012/0013691 A1 1/2012 Harris et al.
2014/0178110 A1* 6/2014 Yagi ..... G03G 15/162 399/302

FOREIGN PATENT DOCUMENTS

| | | | |
|---|---|---|---|
| JP | H07-017030 | A | 1/1995 |
| JP | 2000-280460 | A | 10/2000 |
| JP | 2001-277715 | A | 10/2001 |
| JP | 2002-370442 | A | 12/2002 |
| JP | 2003-182064 | A | 7/2003 |
| JP | 2006-137127 | A | 6/2006 |
| JP | 2007-069584 | A | 3/2007 |
| JP | 2007-268802 | A | 10/2007 |
| JP | 4418619 | B2 | 2/2010 |
| JP | 2010-280132 | A | 12/2010 |
| JP | 4931751 | B2 | 5/2012 |

* cited by examiner

*Primary Examiner* — Jannelle M Lebron

(74) *Attorney, Agent, or Firm* — Canon U.S.A., Inc. IP Division

(57) ABSTRACT

An intermediate transfer member for use in an image-recording method that includes applying a reaction liquid to an intermediate transfer member, forming an intermediate image by applying an ink to the intermediate transfer member to which the reaction liquid has been applied, and transferring the intermediate image to a recording medium. The intermediate transfer member has protruding structures having an average height of 3.0 μm or less on a surface thereof. An average ratio R of surface areas of the intermediate transfer member to a unit area of a surface of the intermediate transfer member and an average ratio S of a total surface area of upper portions of the protruding structures to a unit area of the surface of the intermediate transfer member satisfy the following formula (1):

$$S \leq \tfrac{1}{24} \cdot (10R - 13) \quad (1)$$

wherein $R \geq 1.3$, and $0 \leq S \leq 1$.

10 Claims, 2 Drawing Sheets

INTERMEDIATE TRANSFER MEMBER, IMAGE-RECORDING METHOD, AND IMAGE-RECORDING APPARATUS

BACKGROUND OF THE INVENTION

1. Field of the Invention

The present invention relates to an intermediate transfer member, an image-recording method, and an image-recording apparatus.

2. Description of the Related Art

With increasing diversity in information, a wider range of printed materials are being produced in smaller lots. In order to meet such market demands, ink jet printing methods are receiving attention as suitable techniques. However, ink jet printing methods sometimes cause particular deterioration of image quality. The following two phenomena can be responsible for the deterioration of image quality.

One phenomenon is bleeding. In bleeding, an ink directly applied to a print sheet having high surface flatness and smoothness using an ink jet device is insufficiently absorbed into the print sheet, and remaining adjacent ink droplets on the print sheet are combined together.

The other phenomenon is beading. In beading, an ink droplet on a print sheet is attracted by a subsequently applied ink droplet, thereby causing poor image formation or insufficient drying.

In addition to these phenomena, the deterioration of image quality may result from curling or cockling due to excessive absorption of ink liquid into a recording medium.

In order to avoid the deterioration of image quality, an intermediate transfer type image-recording method has been proposed. This image-recording method includes the following processes (1) to (3).

(1) A reaction liquid applying process: A reaction liquid that can increase the viscosity of a coloring material component of an ink is applied to an intermediate transfer member.

(2) An intermediate image forming process: The ink containing the coloring material component is applied with an ink jet device to the intermediate transfer member to which the reaction liquid has been applied, thereby forming an intermediate image.

(3) A transferring process: The intermediate image on the intermediate transfer member is transferred to a recording medium by pressure bonding.

An image-recording apparatus used in the image-recording method includes an intermediate transfer member for holding an intermediate image.

Japanese Patent Laid-Open No. 2003-182064 discloses an intermediate transfer member for use in a known intermediate transfer type image-recording method. The intermediate transfer member includes a rubber layer on a metallic drum substrate, and a surface layer member on the rubber layer. The material of the rubber layer may be selected from polyurethane, fluorinated elastomers, fluorinated rubbers, and silicone rubbers. The material of the surface layer member may be selected from sol-gels, Ceramer, and polyurethane. Japanese Patent Laid-Open No. 2007-268802 discloses that when the application amount of reaction liquid per unit area is greater than or equal to the application amount of ink per unit area, high-quality images can be produced even in the case that a sink mark is formed by evaporation of the reaction liquid. Japanese Patent Laid-Open No. 2002-370442 discloses that image quality and transferability can be improved when an intermediate transfer member has a surface roughness Ra in the range of 0.2 to 2.5 μm. Japanese Patent Laid-Open No. 2000-280460 discloses an intermediate transfer member having a rough surface. Japanese Patent Laid-Open No. 2001-277715 discloses an intermediate transfer member having protrusions having a height of 5 μm or more on the surface thereof.

SUMMARY OF THE INVENTION

The present invention provides an intermediate transfer member for use in an image-recording method that comprises a process for applying a reaction liquid to an intermediate transfer member, a process for forming an intermediate image by applying an ink to the intermediate transfer member to which the reaction liquid has been applied, and a process for transferring the intermediate image to a recording medium.

The intermediate transfer member has protruding structures having an average height of 3.0 μm or less on a surface thereof, and an average ratio R of surface areas of the intermediate transfer member to a unit area of a surface of the intermediate transfer member and an average ratio S of a total surface area of upper portions of the protruding structures to a unit area of the surface of the intermediate transfer member satisfy the following formula (1):

$$S \leq \tfrac{1}{24} \cdot (10R - 13) \quad (1)$$

wherein $R \geq 1.3$, and $0 \leq S \leq 1$.

The present invention also provides an image-recording method that comprises applying a reaction liquid to an intermediate transfer member, forming an intermediate image by applying an ink to the intermediate transfer member to which the reaction liquid has been applied, and transferring the intermediate image to a recording medium, wherein the intermediate transfer member has protruding structures having an average height of 3.0 μm or less on a surface thereof, and an average ratio R of surface areas of the intermediate transfer member to a unit area of the surface of the intermediate transfer member and an average ratio S of a total surface area of upper portions of the protruding structures to a unit area of the surface of the intermediate transfer member satisfy the following formula (1):

$$S \tfrac{1}{24} \cdot (10R - 13) \quad (1)$$

wherein $R \geq 1.3$, and $0 \leq S \leq 1$.

Further features of the present invention will become apparent from the following description of exemplary embodiments with reference to the attached drawings.

DESCRIPTION OF THE EMBODIMENTS

In an intermediate transfer type image-recording method according to an embodiment of the present invention, a liquid (reaction liquid) that comes into contact with a coloring material component of an ink and increases the viscosity of the resulting intermediate image is applied to an intermediate transfer member. In the field of commercial printing, image reproducibility is important. As a result of studies, the present inventors found that the state of applied reaction liquid sometimes has an influence on image reproducibility.

However, Japanese Patent Laid-Open No. 2003-182064 does not describe the structure of an intermediate transfer member required to stabilize the state of applied reaction liquid. In particular, when the intermediate transfer member is formed of a low surface energy material, such as fluorinated rubber, among the exemplary materials, the intermediate transfer member repels the reaction liquid. Thus, it is difficult for the reaction liquid to be stable on the intermediate transfer member. It is also difficult to control repelling of the reaction liquid from the intermediate transfer member. This results in poor image reproducibility.

Japanese Patent Laid-Open No. 2007-268802 discloses a structure in which a reaction liquid having a surface tension of 28.0 mN/m and a low pH has a contact angle of 62 degrees on an intermediate transfer member formed of a silicone rubber. However, the present inventors found that in the structure described in Japanese Patent Laid-Open No. 2007-268802, the wettability of the intermediate transfer member with the reaction liquid is still insufficient, and it is difficult to stabilize the state of the reaction liquid applied to the intermediate transfer member.

Japanese Patent Laid-Open No. 2002-370442 also does not describe a technique for stabilizing the state of applied reaction liquid, which should be important in improving image quality.

In order to improve image reproducibility, a surface of an intermediate transfer member may be roughened to securely hold a reaction liquid and stabilize the state of applied reaction liquid. However, roughening of a surface of an intermediate transfer member results in poor releasability of an intermediate image from the intermediate transfer member and poor intermediate image transferability. Thus, there is a trade-off between image reproducibility and intermediate image transferability.

The present inventors examined these techniques. As a result, the present inventors found that the formation of protruding structures that satisfy a predetermined relationship on an intermediate transfer member can improve both image reproducibility and intermediate image transferability. In consideration of these existing problems, the present invention provides an intermediate transfer member, an image-recording method, and an image-recording apparatus, that can achieve high image reproducibility and intermediate image transferability.

1. Image-Recording Apparatus

Figure 1:
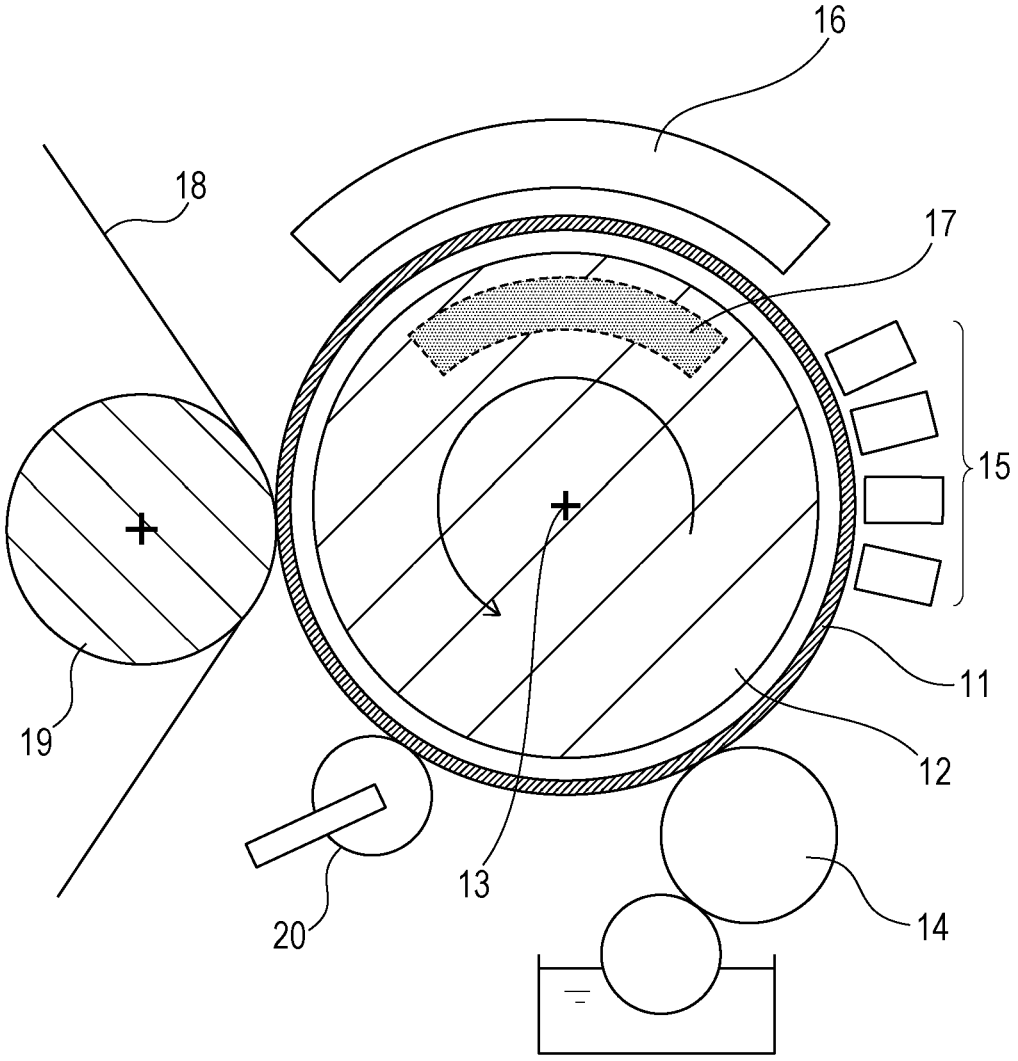
FIG. 1 is a schematic view of an image-recording apparatus that includes an intermediate transfer member according to an embodiment of the present invention.
Figure 2A:
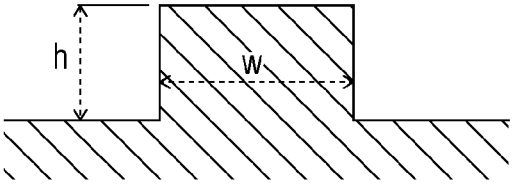
FIGS. 2A to 2F are cross-sectional views of protruding structures on a surface of an intermediate transfer member according to an embodiment of the present invention.
Figure 2D:
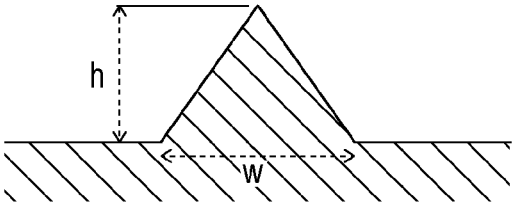
Figure 2B:
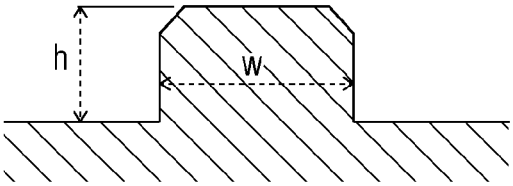
Figure 2E:
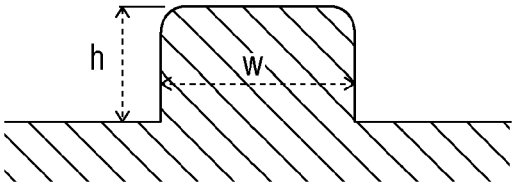
Figure 2C:
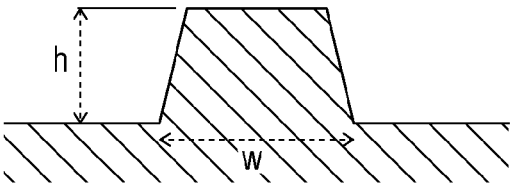
Figure 2F:
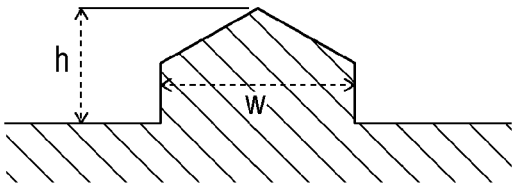

An image-recording apparatus according to an embodiment of the present invention includes an intermediate transfer member, a reaction liquid applying unit configured to apply a reaction liquid to the intermediate transfer member, an ink applying unit configured to apply an ink to the intermediate transfer member and form an intermediate image, and a transferring unit configured to transfer the intermediate image to a recording medium. FIG. 1 is a schematic view of an image-recording apparatus according to the present embodiment. In FIG. 1, an intermediate transfer member includes a drum-shaped supporting member 12, which is rotatable on a rotating shaft 13, and a surface layer member 11 on the supporting member 12. The supporting member 12 rotates on the shaft 13 in the direction of the arrow. Peripheral devices around the intermediate transfer member operate in synchronism with the rotation.

The image-recording apparatus illustrated in FIG. 1 performs image recording as described below. An application roller of a roller application device (reaction liquid applying unit) 14 abuts against the circumferential surface of the intermediate transfer member. A reaction liquid is applied to the intermediate transfer member with the roller application device 14. An ink is then applied to the intermediate transfer member with an ink jet recording head (ink applying unit) 15, which faces the circumferential surface of the intermediate transfer member, thus forming an intermediate image. The intermediate image on the intermediate transfer member is then dried with a blower 16, which faces the intermediate transfer member, and a heater 17 disposed within the supporting member 12, thereby evaporating liquid components of the intermediate image. This can suppress quality deterioration of the intermediate image during transfer described later. The intermediate image on the intermediate transfer member is then brought into contact with a recording medium 18 using a pressure roller (transferring unit) 19, which abuts against the circumferential surface of the intermediate transfer member with the recording medium 18 interposed therebetween, thereby transferring the intermediate image to the recording medium 18. In the apparatus illustrated in FIG. 1, the intermediate image can be efficiently transferred by pressing the intermediate image and the recording medium 18 between the supporting member 12 and the pressure roller 19. A molleton roller of a cleaning unit 20 intermittently abuts against the circumferential surface of the intermediate transfer member. The molleton roller is wet with ion-exchanged water. After the intermediate image is transferred to the recording medium 18, the intermediate transfer member is cleaned with the cleaning unit 20 and is then used to form another intermediate image.

The intermediate transfer member has protruding structures having an average height of 3.0 μm or less (hereinafter also referred to simply as "protruding structures") on the surface thereof. The average ratio R of surface areas of the intermediate transfer member to a unit area of the surface of the intermediate transfer member and the average ratio S of the total surface area of upper portions of the protruding structures to a unit area of the surface of the intermediate transfer member satisfy the following formula (1):

$$S \leq \tfrac{1}{24} \cdot (10R - 13) \quad (1)$$

wherein $R \geq 1.3$, and $0 \leq S \leq 1$.

The operational advantages of the apparatus illustrated in FIG. 1 will be described below.

In general, the static contact angle $\Phi$ of a droplet on a composite surface composed of two components having different wettabilities, the static contact angle $\Phi_1$ between the droplet and a surface component 1, the static contact angle $\Phi_2$ between the droplet and a surface component 2, and the area ratio S of the surface component 1 on the surface satisfy the Cassie equation represented by the following formula (2).

$$\cos \Phi = S \cdot \cos \Phi_1 + (1 - S) \cdot \cos \Phi_2 \quad (2)$$

Thus, $S \cdot \cos \Phi_1$ or $(1-S) \cdot \cos \Phi_2$ can be increased to decrease $\Phi$. In other words, in the case of small $\Phi_1$, the area ratio S of the surface component 1 is maximized, and in the case of small $\Phi_2$, the area ratio (1−S) of the surface component 2 is increased.

A reaction liquid enters the space between adjacent protruding structures, covers a surface layer member of an intermediate transfer member, and forms a layer. When the uppermost surface layer of the intermediate transfer member is considered to be an interface, the interface is considered to be a composite surface composed of upper portions of protruding structures of the intermediate transfer member and the reaction liquid. Thus, when the area ratio of the upper portions of the protruding structures on the composite surface is denoted by S, and the area ratio of the reaction liquid component is denoted by (1−S), according to the equation (2), (1−S) can be maximized to improve the wettability of the interface with the reaction liquid layer. In other words, the average ratio S of the total surface area of the upper portions of the protruding structures to a unit area of the surface of the intermediate transfer member can be decreased.

Since the average ratios R and S are not independent factors, the present inventors examined an appropriate relationship between these factors as described below. The desired state of applied reaction liquid on the surface of the intermediate transfer member satisfies the following two conditions.

First, the reaction liquid is not repelled by the surface of the intermediate transfer member and can cover the surface of the intermediate transfer member. Under this condition, the average ratio R has a great influence, and at a high average ratio R, the reaction liquid can easily spread over and cover the surface of the intermediate transfer member. Thus, the average ratio R can be as high as possible.

Second, the reaction liquid forms a layer as uniformly as possible on the surface of the intermediate transfer member. Under this condition, the average ratio S has a great influence, and a low average ratio S results in a low percentage of the upper portions of the protruding structures on the surface of the intermediate transfer member and the formation of a uniform reaction liquid layer on the intermediate transfer member. Thus, the average ratio S can be as low as possible.

Considering these two conditions, the present inventors made extensive studies on the appropriate average ratios R and S in various test examples. As a result, it was found that the factors should satisfy the following formula (1) in order to satisfy the two conditions.

$$S \leq \tfrac{1}{24} \cdot (10R - 13) \quad (1)$$

As described below, image reproducibility and intermediate image transferability can be improved by forming protruding structures that satisfy the formula (1) on the surface of the intermediate transfer member.

In related techniques, a portion of ink in contact with a reaction liquid reacts with the reaction liquid and forms an intermediate image. The intermediate image sometimes undergoes deformation, such as shrinkage, due to a nonuniform reaction between the reaction liquid and the ink. For example, owing to a nonuniform aggregation reaction between the reaction liquid and the ink, a portion of the intermediate image in which the aggregation reaction is retarded has insufficient cohesive force, and suffers a cohesive failure while the intermediate image is transferred. In order to prevent the deformation of intermediate images, protruding structures may be formed on the surface of the intermediate transfer member. In related techniques, however, a rough surface due to the formation of protruding structures on the intermediate transfer member results in poor intermediate image transferability.

In the present embodiment, protruding structures that satisfy the formula (1) are formed on the surface of the intermediate transfer member. The protruding structures can decrease the apparent static contact angle of a reaction liquid and improve the wettability of the surface of the intermediate transfer member with the reaction liquid. The protruding structures allow the reaction liquid to spread uniformly over a desired region on the surface of the intermediate transfer member, increase the area of applied reaction liquid, and improve the applicability of the reaction liquid. The improved applicability of the reaction liquid results in uniform progress of the reaction between the reaction liquid and the ink and can suppress deformation of an intermediate image. Furthermore, the improved applicability of the reaction liquid can decrease the area of the intermediate transfer member not covered with the reaction liquid. This can improve reproducibility of the state of applied reaction liquid while image recording is continuously performed. Furthermore, intermediate images can have appropriate releasability on the intermediate transfer member when transferred. Thus, both image reproducibility and intermediate image transferability can be improved. The term "protruding structures", as used herein, refers to protrusions having a certain height on a surface (for example, a bottom face) of an intermediate transfer member.

In general, the static contact angle θ of a droplet on a smooth solid surface, the surface tension $\gamma_L$ of a liquid, the surface tension $\gamma_S$ of a solid, and the surface tension $\gamma_{SL}$ of a solid-liquid interface satisfy the following Young equation.

$$\gamma_S = \gamma_{SL} + \gamma_L \cdot \cos\theta$$

The relationship between roughness and wettability of a solid surface can be represented by a Wenzel model. On a solid surface having predetermined roughness, the solid-liquid contact area increases due to the roughness. The apparent static contact angle θ' on the rough surface is represented by the following equation, wherein R denotes the average ratio of surface areas of the solid to a unit area of the solid.

$$\cos\theta' = R \cdot (\gamma_S - \gamma_{SL})/\gamma_L = R \cdot \cos\theta \quad (3)$$

The equation (3) shows that R≥1 and 0<θ<90 degrees result in θ'<θ.

In order to stabilize the state of applied reaction liquid in the present embodiment, it is important to avoid the reaction liquid being incidentally repelled. In the presence of a reaction liquid applied portion and unapplied portion, it is difficult to consistently control the area ratio of the reaction liquid applied portion. It is therefore assumed that the reaction liquid can be stabilized by applying the reaction liquid to the intermediate transfer member as widely and uniformly as possible, that is, by increasing the area of the reaction liquid applied portion. Thus, in order to spread the reaction liquid over the surface of the intermediate transfer member and increase the area of the reaction liquid applied portion, the apparent static contact angle of the reaction liquid on the intermediate transfer member can be decreased to improve the wettability of the intermediate transfer member with the reaction liquid. More specifically, the apparent static contact angle is preferably 40 degrees or less, more preferably 20 degrees or less.

In order to decrease the apparent static contact angle on the intermediate transfer member, the average ratio R of surface areas of the intermediate transfer member to a unit area of the surface of the intermediate transfer member should be 1.3 or more. Under this condition, the reaction liquid on the intermediate transfer member can enter the space between adjacent protruding structures on the intermediate transfer member and spread over the intermediate transfer member. This results in a decreased area of a reaction liquid unapplied portion on the intermediate transfer member. R preferably ranges from 1.3 to 3. This can more steadily decrease the apparent static contact angle and increase the area of the reaction liquid applied portion on the intermediate transfer member.

The amount of reaction liquid to be applied is such that the protruding structures on the intermediate transfer member can be sufficiently covered with the reaction liquid. In the present embodiment, the applicability of the reaction liquid can be improved by increasing the average ratio R of surface areas of the intermediate transfer member.

Methods for measuring the average ratios R and S and the uniformity of the reaction liquid layer on the intermediate transfer member will be described below. Method for Measuring Average Ratio R of Surface Areas of Intermediate Transfer Member to Unit Area of Intermediate Transfer Member For a 1 cm×1 cm sheet of an intermediate transfer member, the unit area of the surface of the intermediate transfer member can be calculated as the product of the length and the width without consideration of the surface profile. Even in the case of an intermediate transfer member having a shape other than the sheet form, the unit area of the surface of the intermediate transfer member can be calculated from the surface area on the assumption that the average surface roughness Ra=0 μm, that is, the surface area of a flattened intermediate transfer member. The size of a sample cut from an intermediate transfer member can be changed.

The average ratio R of surface areas of an intermediate transfer member to a unit area of the surface of the intermediate transfer member can be measured with a scanning probe microscope (SPM), which can measure the three-dimensional shape of a surface of a sample by scanning the surface of the sample with a fine probe (cantilever). For example, the geometry of a 10 μm×10 μm area on a surface of a sample having a certain size cut from an intermediate transfer member is measured multiple times with a scanning probe microscope. Height information for an intermediate transfer member can be acquired with an SPM at intervals of tens of nanometers. The average ratio R of surface areas of an intermediate transfer member to a unit area of the surface of the intermediate transfer member can be determined by dividing by 100 $\mu m^2$ the sum total area of a plurality of triangles each formed by three adjacent points of measurement. A triangle formed by three adjacent points of measurement can include no other point of measurement within the triangle. A triangle can be separated from another triangle.

Method for Measuring Average Ratio S of Total Surface Area of Upper Portions of Protruding Structures to Unit Area of Intermediate Transfer Member The upper portion of each protruding structure on an intermediate transfer member is a portion above a surface disposed at a level corresponding to 95% of the maximum height of the corresponding protruding structure parallel to a flattened surface of the intermediate transfer member. Although different protruding structures have different surfaces parallel to the flattened surface of the intermediate transfer member, the surface parallel to the flattened surface may be the highest surface or a surface having a height equal to the average height of the protruding structures. The average ratio S is an approximate ratio of the sum total of the surface areas of the protruding portions to a unit area of the surface of the intermediate transfer member. The maximum height of a protruding structure is a height from the lowest bottom to the highest top or apex in a cross section of the protruding structure including the lowest bottom and the highest top or apex in a plane perpendicular to a flattened surface of the intermediate transfer member. For example, in the case of a conical protruding structure, a cross section including the apex of the conical protruding structure is triangular, and the height from the base to the apex of the triangle is the maximum height of the protruding structure. The maximum height of a protruding structure is preferably 0.05 μm or more, and such a structure is considered to be a protruding structure in an embodiment of the present invention.

The average ratio S is measured as described below. For a 1 cm×1 cm sheet of an intermediate transfer member, the unit area of the surface of the intermediate transfer member can be calculated as the product of the length and the width without consideration of the surface profile. The size of a sample cut from an intermediate transfer member can be changed. The average ratio S of the total surface area of upper portions of protruding structures on an intermediate transfer member to a unit area of the surface of the intermediate transfer member can be measured with a scanning probe microscope (SPM), which can measure the three-dimensional shape of a surface of a sample by scanning the surface of the sample with a fine probe (cantilever). For example, the geometry of a 10 μm×10 μm area on a surface of a sample having a certain size cut from an intermediate transfer member is measured multiple times with a scanning probe microscope. Height information for an intermediate transfer member can be acquired with an SPM at intervals of tens of nanometers. The upper portion of each protruding structure is a set of points of measurement having a height of 95% or more of the maximum height of the corresponding protruding structure. The average ratio S of the total surface area of upper portions of protruding structures on an intermediate transfer member to a unit area of the surface of the intermediate transfer member can be determined by dividing by 100 $\mu m^2$ the sum total area of a plurality of triangles each formed by three adjacent points of measurement.

Determination of Uniformity of Reaction Liquid Layer on Intermediate Transfer Member A reaction liquid is applied with a gravure roller to a surface of a sample having a certain size cut from an intermediate transfer member. For example, a 100 μm×100 μm area on the surface of the sample is observed with an optical microscope, and a color change due to interference is recorded. The uniformity of the reaction liquid layer can be calculated as the area ratio of a uniform portion in which interference is not observed in the 10,000 $\mu m^2$ area.

An intermediate transfer member, an image-recording method, an image-recording apparatus, and components thereof according to the present embodiment will be described in detail below.

<Intermediate Transfer Member>

An intermediate transfer member can hold reaction liquid and ink, serves as a base on which an intermediate image is formed, and has protruding structures on a surface thereof. An intermediate transfer member includes a supporting member for handling the intermediate transfer and transmitting required force, and a surface layer member on which an image is formed. The supporting member and the surface layer member may be composed of a single component or a plurality of independent components.

The surface layer member of the intermediate transfer member may be composed of a single layer or a plurality of layers. The surface layer member of the intermediate transfer member may have any layer structure depending on the type of recording medium, the ability to hold an intermediate image on the intermediate transfer member, efficiency in image transfer to a recording medium, and the image quality of an intermediate image. For example, the surface layer member of the intermediate transfer member may include a compressible layer for making uneven pressure uniform during transfer. The compressible layer is a porous rubber or elastomer layer and may be formed of a known material. The surface layer member of the intermediate transfer member may include a resin layer, a base fabric layer, and/or a metal layer that can improve the elastic properties, strength, and/or thermal properties of the surface layer member. An adhesive agent or double-sided tape for fixing and holding the surface layer member and the supporting member may be disposed between the surface layer member and the supporting member. The intermediate transfer member may have a shape of a sheet, roll, drum, belt, or endless web. A drum-shaped or belt-shaped endless web intermediate transfer member can be continuously and repeatedly used with high productivity. The intermediate transfer member may have any size depending on the size of a recording medium to be used.

The supporting member of the intermediate transfer member should have a sufficient structural strength with respect to durability and the accuracy with which a recording medium is conveyed. The supporting member can be formed of a metal, ceramic, or polymer. In particular, the supporting member can be formed of one of the following materials in terms of dimensional accuracy and rigidity to withstand transferring pressure and in order to decrease operational inertia and improve control responsiveness. These materials may be used in combination. Aluminum, iron, stainless steel, acetal resin, epoxy resin, polyimide, polyethylene, polyethylene terephthalate, nylon, polyurethane, silica ceramic, and/or alumina ceramic.

An intermediate image on the surface layer member of the intermediate transfer member is transferred to a recording medium, such as a paper sheet, by pressure bonding. It is therefore desirable that the surface layer member have moderate elasticity. For example, when the recording medium is a paper sheet, the surface layer member preferably contains a rubber component having durometer type A hardness in the range of 10 to 100 degrees, more preferably 20 to 60 degrees, according to JIS K 6253.

The material of the surface layer member may be a polymer, ceramic, or metal and may be a rubber or elastomer in terms of characteristics and processability. In particular, when the surface layer member is formed of a water-repellent material having moderately low surface energy, owing to low adhesion energy between the water-repellent material and a reaction aggregate of reaction liquid and ink, intermediate image transfer efficiency can be improved. More specifically, the static contact angle of water on a smooth surface of an intermediate transfer member is preferably 90 degrees or more. The smooth surface has an arithmetic average roughness Ra of approximately 0.1 μm or less. In order to have such a static contact angle, the surface layer member may contain a compound containing a fluorine or silicone compound. More specifically, the surface layer member may contain a silicone rubber, a fluororubber, or a compound having a skeletal structure of silicone rubber or fluororubber. The surface layer member may include a surface layer on a layer formed of the material described above. From the perspective of surface energy, the surface layer can be formed of a compound having a water-repellent structure, such as a silicone skeleton or a perfluoroalkyl skeleton.

The average height of protruding structures is the average length from the base to the highest portion of the protruding structures in a plane perpendicular to a flattened surface of the intermediate transfer member. As described above, the protruding structures have an average height of 3.0 μm or less, preferably 1.0 μm or less. The average height of protruding structures is denoted by "h" in the protruding structures illustrated in FIGS. 2A to 2F. FIGS. 2A to 2F illustrate protruding structures having rectangular, triangular, and trapezoidal cross sections and combinations thereof. In these protruding structures having various cross-sections, the average height of the protruding structures is the average length from the base to the highest portion in the cross-sections of the protruding structures. When the protruding structures have an average height of more than 3.0 μm, image reproducibility and intermediate image transferability are insufficient. The protruding structures of the intermediate transfer members described in Japanese Patent Laid-Open No. 2000-280460 and No. 2001-277715 have an average height of more than 3.0 μm. Thus, these intermediate transfer members have insufficient image reproducibility and intermediate image transferability. When the protruding structures have an average height of 1.0 μm or less, this results in sufficient transfer pressure between the intermediate transfer member and a recording medium and improved intermediate image transferability.

The protruding structures preferably have an average width of 1.0 μm or less. The average width is the average length of the widest portion of the protruding structures in a plane perpendicular to a flattened surface of the intermediate transfer member. The average width of protruding structures is denoted by "w" in the protruding structures illustrated in FIGS. 2A to 2F. As illustrated in FIGS. 2A to 2F, in the protruding structures having various cross-sections, the average width of the protruding structures is the average length of the widest portion in the cross-sections of the protruding structures. The intervals of the protruding structures are preferably 1.0 μm or less. The intervals are the shortest distances between the side walls of adjacent protruding structures in the array direction. The protruding structures having these dimensions can make the state of applied reaction liquid uniform on the intermediate transfer member and improve image reproducibility. The average width and intervals of the protruding structures can be calculated from the three-dimensional measurement data of the surface of the intermediate transfer member measured with a scanning probe microscope.

The protruding structures may have any shape and may be pillar-, cone-, moth-eye-, or frustum-shaped. The term "moth-eye-shaped", as used herein, refers to a shape in which conical shapes are arranged at regular intervals. When the protruding structures are pillar- or cone-shaped, the protruding structures may be an N-sided prism or pyramid (N denotes a natural number). The protruding structures on the surface of the intermediate transfer member may have different shapes selected from pillar, cone, moth-eye, and frustum shapes. The frustum shape is part of a cone shape between the base and a plane parallel to the base. Pillar-shaped protruding structures can effectively increase the average ratio R of surface areas of an intermediate transfer member to a unit area of the surface of the intermediate transfer member. With cone-shaped protruding structures, the average ratio S of the total surface area of upper portions of protruding structures on an intermediate transfer member to a unit area of the surface of the intermediate transfer member can be effectively decreased to approximately zero. Cone-, moth-eye-, and frustum-shaped protruding structures are less prone to deformation, such as toppling, during continuous image recording.

The protruding structures on the surface of the intermediate transfer member may be arranged in an array of squares or triangles or may be randomly arranged. The protruding structures in an array of squares are arranged at regular intervals in horizontal and vertical directions, that is, in a grid pattern. In the protruding structures in an array of triangles, three protruding structures form each triangle. The protruding structures in a random array are arranged randomly within the scope of the present invention. These arrangements may affect image quality and may be chosen so as not to affect image quality. The protruding structures in a random array can sometimes suppress the interference of light.

Protruding structures can be formed by transferring a desired shape from a mold to a surface of an intermediate transfer member by a known method. In particular, protruding structures having a fine pattern can be formed by a known nanoimprint method. In the nanoimprint method, a mold having a fine pattern is pressed against a polymer or glass substrate to transfer the desired shape. The mold can be manufactured from a silicon wafer by utilizing photolithography or etching. A microfabrication method, such as electron beam lithography, may also be used. A mold for use in the nanoimprint method may have a groove corresponding to protruding structures having a desired height, width, and pitch. More specifically, protruding structures having a height A, a width B, and a pitch C may be formed using a mold having a groove of substantially the same dimensions, that is, the depth A, the width B, and the pitch C.

Porous alumina manufactured by anodic oxidation of an aluminum material in an acid liquid has regularly arranged columnar pores. In protruding structures formed of porous alumina, the pitch of the protruding structures can be controlled by texturing before anodic oxidation and the type of electrolyte and the voltage used in anodic oxidation. The depth of the protruding structures can be controlled via anodic oxidation time. The width and intervals of the protruding structures can be controlled by etching pores after anodic oxidation. Porous alumina or a negative structure formed by using the porous alumina as a mold can also be used to transfer its shape to a surface of an intermediate transfer member.

<Reaction Liquid>

The reaction liquid contains a component that can increase the viscosity of an ink for use in an image-recording method according to the present embodiment (hereinafter also referred to as an "ink viscosity increasing component"). The increase in viscosity of an ink means that a coloring material or resin in the ink chemically reacts with or physically adsorbs to the ink viscosity increasing component, thereby increasing the viscosity of the ink. The increase in viscosity of an ink also includes a local increase in viscosity due to aggregation of part of an ink composition, such as a coloring material. The "reaction" with respect to the "reaction liquid" refers to not only a chemical reaction with an ink but also physical action (such as adsorption). The ink viscosity increasing component has an effect of reducing the flow of ink and/or part of an ink composition on an intermediate transfer member, thereby suppressing bleeding and beading during the image-forming period.

The ink viscosity increasing component may be a known component, such as a polyvalent metal ion, an organic acid, a cationic polymer, or porous fine particles. In particular, the ink viscosity increasing component may be a polyvalent metal ion or an organic acid. The reaction liquid can contain a plurality of types of ink viscosity increasing components. The ink viscosity increasing component content of the reaction liquid depends on the type of ink viscosity increasing component, the conditions under which the reaction liquid is applied to an intermediate transfer member, and the type of ink. For example, the ink viscosity increasing component content of the reaction liquid can be 5% by mass or more.

Specific examples of a metal ion to be used as an ink viscosity increasing component include, but are not limited to, divalent metal ions and trivalent metal ions. Examples of the divalent metal ions include, but are not limited to, $Ca^{2+}$, $Cu^{2+}$, $Ni^{2+}$, $Mg^{2+}$, $Sr^{2+}$, $Ba^{2+}$, and $Zn^{2+}$. Examples of the trivalent metal ions include, but are not limited to, $Fe^{3+}$, $Cr^{3+}$, $Y^{3+}$, and $Al^{3+}$.

Specific examples of an organic acid to be used as an ink viscosity increasing component include, but are not limited to, oxalic acid, poly(acrylic acid), formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, oxysuccinic acid, and dioxysuccinic acid.

The reaction liquid may contain proper amounts of water and/or an organic solvent. Water can be deionized water, for example, produced by ion exchange. The organic solvent is not particularly limited and may be any known organic solvent. The reaction liquid may contain a resin. A resin in the reaction liquid can improve adhesion of an intermediate image to a recording medium during transfer or increase the mechanical strength of final images. The resin may be composed of any material, provided that the resin can coexist with the ink viscosity increasing component.

The surface tension and viscosity of the reaction liquid can be adjusted by the addition of a surfactant and/or a viscosity modifier. The surfactant and the viscosity modifier may be composed of any material, provided that they can coexist with the ink viscosity increasing component. The surfactant may be Acetylenol E100 (manufactured by Kawaken Fine Chemicals Co., Ltd.). The reaction liquid preferably has surface energy of 50 mN/m or less, more preferably 20 to 40 mN/m. The reaction liquid on a smooth surface of an intermediate transfer member preferably has a static contact angle of 40 degrees or less, more preferably 20 degrees or less. The reaction liquid having a static contact angle of 40 degrees or less can effectively improve the wettability of an intermediate transfer member with the reaction liquid.

The reaction liquid can contain a fluorinated surfactant. Fluorinated surfactants have a hydrophobic fluorocarbon chain and a hydrophilic molecular chain (hydrophilic moiety) in their molecular structures. The hydrophobic fluorocarbon chain can decrease surface tension, as described above. In particular, the fluorinated surfactant can be a nonionic surfactant that has a fluoroalkyl chain in a hydrophobic moiety and an ethylene oxide chain as a hydrophilic moiety. The fluoroalkyl chain in a hydrophobic moiety and the ethylene oxide chain as a hydrophilic moiety can improve compatibility with a solvent and a reactant. Thus, the nonionic surfactant has high solubility even in a composition having a low water content due to drying and can maintain uniformity of a reaction liquid layer and an ability to lower the surface tension of the reaction liquid layer. The nonionic surfactant can maintain its structure and consequently its characteristics even after the reaction with ink. Thus, the nonionic surfactant can maintain uniformity of a reaction liquid layer and an ability to lower the surface tension of the reaction liquid layer. Examples of such a surfactant include, but are not limited to, FSO100, FSN100, and FS3100 (manufactured by Du Pont), and F444, F477, and F553 (manufactured by DIC Corporation). The reaction liquid preferably has surface energy of 20 mN/m or less. The fluorinated surfactant content of the reaction liquid preferably ranges from 1% to 15% by mass. The ability to lower the surface tension of the reaction liquid layer decreases with the fluorinated surfactant content. Thus, at a relatively low fluorinated surfactant content, the average ratio R of surface areas of an intermediate transfer member to a unit area of the surface of the intermediate transfer member can be increased. For example, at a fluorinated surfactant content of 5% by mass, R is preferably 1.5 or more. At a fluorinated surfactant content of 1% by mass, R is preferably 1.7 or more.

<Ink>

The components of an ink according to an embodiment of the present invention will be described below.

(1) Coloring Material

An ink according to an embodiment of the present invention can contain at least one of a pigment and a dye. The dye and pigment are not particularly limited and may be any dye and pigment that can be used as coloring materials for inks.

Required amounts of dye and pigment can be used. For example, known dyes, carbon black, and organic pigments for use in ink jet inks can be used. A dye and/or a pigment dissolved and/or dispersed in a liquid medium can be used. In particular, pigments can impart high durability and characteristic quality to printed materials.

(2) Pigment

An ink according to an embodiment of the present invention can contain any pigment, such as a known inorganic or organic pigment. More specifically, pigments having various color index (C.I.) numbers can be used. Carbon black can be used as a black pigment. The pigment content of an ink according to an embodiment of the present invention preferably ranges from 0.5% to 15.0% by mass, more preferably 1.0% to 10% by mass.

(3) Pigment Dispersant

An ink according to an embodiment of the present invention can contain a dispersant for dispersing a pigment, such as a known dispersant for use in an ink jet system. In particular, the pigment dispersant can be a water-soluble dispersant having both a hydrophilic moiety and a hydrophobic moiety in its molecular structure. In particular, the pigment dispersant can be composed of a resin produced by copolymerization of at least a hydrophilic monomer and a hydrophobic monomer. These monomers are not particularly limited and may be any known monomers. More specifically, examples of the hydrophobic monomer include, but are not limited to, styrene, styrene derivatives, alkyl(meth)acrylates, and benzyl(meth) acrylate. Examples of the hydrophilic monomer include, but are not limited to, acrylic acid, methacrylic acid, and maleic acid. The dispersant preferably has an acid value in the range of 50 to 550 mgKOH/g. The dispersant preferably has a weight-average molecular weight in the range of 1,000 to 50,000. The mass ratio of the pigment to the dispersant in the ink preferably ranges from 1:0.1 to 1:3. An ink according to another embodiment of the present invention can contain a self-dispersing pigment and no dispersant. The self-dispersing pigment is a surface-modified pigment that can be dispersed by itself without a dispersant.

(4) Polymer Particles

An ink according to an embodiment of the present invention can contain various types of particles containing no coloring material. In particular, polymer particles can be effective in improving image quality and fixability. The material of polymer particles is not particularly limited and may be any known polymer. More specifically, examples of the polymer include, but are not limited to, homopolymers, such as polyolefin, polystyrene, polyurethane, polyester, polyether, polyurea, polyamide, poly(vinyl alcohol), poly(meth)acrylic acid and salts thereof, polyalkyl(meth)acrylate, and polydiene, and copolymers of monomers of these homopolymers. The polymer preferably has a weight-average molecular weight in the range of 1,000 to 2,000,000. The polymer particle content of the ink preferably ranges from 1% to 50% by mass, more preferably 2% to 40% by mass. The polymer particles can be used in the form of polymer particles dispersed in ink. The polymer particles may be dispersed by any method. The polymer particles can be in the form of a self-dispersing polymer particle dispersion. In the self-dispersing polymer particle dispersion, polymer particles are dispersed with a homopolymer or copolymer of monomers having a dissociable group. Examples of the dissociable group include, but are not limited to, a carboxy group, a sulfonic acid group, and a phosphate group. Examples of the monomers having the dissociable group include, but are not limited to, acrylic acid and methacrylic acid. An emulsified dispersion type polymer particle dispersion can also be used. In the emulsified dispersion type polymer particle dispersion, polymer particles are dispersed with an emulsifying agent. The emulsifying agent can be a known low molecular weight or high molecular weight surfactant. The surfactant can be nonionic or have the same electric charge as the polymer particles. The polymer particle dispersion preferably has a dispersion particle size in the range of 10 to 1,000 nm, more preferably 100 to 500 nm.

The polymer particle dispersion can contain an additive agent for stabilization. Examples of such an additive agent include, but are not limited to, n-hexadecane, dodecyl methacrylate, stearyl methacrylate, chlorobenzene, dodecyl mercaptan, olive oil, blue dye (Blue 70), and poly(methyl methacrylate).

(5) Surfactant

An ink according to an embodiment of the present invention may contain a surfactant. More specifically, the surfactant may be Acetylenol EH (manufactured by Kawaken Fine Chemicals Co., Ltd.). The surfactant content of the ink preferably ranges from 0.01% to 5.0% by mass.

(6) Water and Water-Soluble Organic Solvent

An ink according to an embodiment of the present invention may contain water and/or a water-soluble organic solvent as a solvent. Water can be deionized water, for example, produced by ion exchange. The water content of the ink preferably ranges from 30% to 97% by mass. The water-soluble organic solvent may be of any type and may be any known water-soluble organic solvent. More specifically, examples of the water-soluble organic solvent include, but are not limited to, glycerin, diethylene glycol, poly(ethylene glycol), and 2-pyrrolidone. The water-soluble organic solvent content of the ink preferably ranges from 3% to 70% by mass.

(7) Other Additive Agents

In addition to these components, an ink according to an embodiment of the present invention may further contain various additive agents, such as a pH adjuster, an anticorrosive, a preservative, a fungicide, an antioxidant, a reducing inhibitor, a water-soluble resin and a neutralizing agent therefor, and a viscosity modifier.

2. Image-Recording Method

An image-recording method according to the present embodiment includes a process for applying a reaction liquid to an intermediate transfer member, a process for forming an intermediate image by applying an ink to the intermediate transfer member to which the reaction liquid has been applied, and a process for transferring the intermediate image to a recording medium.

The processes of the image-recording method according to the present embodiment will be described in detail below.

<Application of Reaction Liquid>

A reaction liquid can be applied to an intermediate transfer member by a known application method. Specific examples of the application method include, but are not limited to, die coating, blade coating, a method using a gravure roller, a method using an offset roller, and spray coating. An application method using an ink jet device can also be used. These methods may be used in combination.

<Formation of Intermediate Image>

An intermediate image is formed by applying an ink to a surface of an intermediate transfer member to which a reaction liquid has been applied. The term "intermediate image", as used herein, refers to an image that is formed on an intermediate transfer member by contact between a reaction liquid and an ink and is finally transferred to a recording medium.

The ink can be applied with an ink jet device. The ink jet device may be as follows:

A device for ejecting ink by causing film boiling of the ink with an electrothermal transducer and forming air bubbles;

A device for ejecting ink using an electromechanical transducer; or

A device for ejecting ink by utilizing static electricity.

Any of such ink jet devices proposed on the basis of ink jet liquid ejection technology may be used. In particular, a device for ejecting ink using an electrothermal transducer can be used from the perspective of high-speed and high-density printing.

The ink jet device may have any structure. For example, the following ink jet heads may be used.

A shuttle type ink jet head, which is scanned perpendicularly to the traveling direction of an intermediate transfer member during recording.

A line head type ink jet head, which includes ink ejection ports aligned substantially perpendicularly to the traveling direction of an intermediate transfer member (substantially parallel to the axial direction in the case of a drum-shaped intermediate transfer member).

<Transfer of Intermediate Image>

An intermediate image on an intermediate transfer member is transferred to a recording medium by pressure bonding, thereby forming a final image. The term "recording medium", as used herein, refers to not only a paper sheet generally used in printing, but also a cloth, plastic, film, and another print medium and recording medium.

Pressure bonding between an intermediate transfer member and a recording medium may be performed by any method. An intermediate image can be efficiently transferred by pressing an intermediate transfer member and a recording medium between pressure rollers. An intermediate transfer member and a recording medium can be pressed stepwise in order to prevent poor transfer.

<Removal of Liquid Components>

After an intermediate image is formed on an intermediate transfer member, liquid components can be removed from the intermediate image. This can prevent excessive liquid components of the intermediate image from being squeezed out or overflowing during the transferring process, thereby preventing quality deterioration of images or poor transfer. Liquid components can be removed from an intermediate image by any known method. Examples of such a method include, but are not limited to, a heating method, a dry air method, a vacuuming method, and a method using an absorbent. These methods may be combined. Natural drying can also be used.

<Cleaning>

In an image-recording method according to the present embodiment, an image is finally formed through the application of a reaction liquid, the formation of an intermediate image by the application of an ink, removal of liquid components, and transfer of the intermediate image. An intermediate transfer member is sometimes used repeatedly and continuously to improve productivity. In such continuous operation, the intermediate transfer member may be cleaned before the formation of another image. An intermediate transfer member may be cleaned by any known method, including the following methods.

A method of applying a shower of cleaning liquid to the surface of the intermediate transfer member.

A method of wiping the surface of the intermediate transfer member with a wet molleton roller.

A method of bringing the surface of the intermediate transfer member into contact with a cleaning liquid.

A method of wiping the surface of the intermediate transfer member with a wiper blade.

A method of applying energy to the surface of the intermediate transfer member.

These methods may be combined.

<Fixing>

After the transferring process, an image on a recording medium may be pressed with a roller to improve image fixability. The image fixability may also be improved by heating the recording medium. Pressing and heating may be simultaneously performed using a heating roller.

Exemplary Embodiments

The present invention will be further described below with exemplary embodiments and comparative examples of an intermediate transfer member, an image-recording apparatus, and an image-recording method. However, the present invention should not be limited to these exemplary embodiments. In the following embodiments, "parts" refers to "parts by mass", and "%" refers to "% bymass".

Image-Recording Apparatus

In the following exemplary embodiments and comparative examples, an image-recording apparatus illustrated in FIG. 1 was used for image recording. An intermediate transfer member having predetermined characteristics was prepared in each of the exemplary embodiments and comparative examples. The apparatus illustrated in FIG. 1 included a cylindrical aluminum alloy drum as a supporting member 12 for an intermediate transfer member. The apparatus had required characteristics, such as rigidity to withstand transferring pressure, dimensional accuracy, and decreased rotational inertia to improve control responsiveness.

A surface layer member 11 of the intermediate transfer member was formed of a silicone rubber having a durometer type A hardness of 60 degrees (KE-106, manufactured by Shin-Etsu Chemical Co., Ltd.) and had a thickness of 0.3 mm in Exemplary Embodiments 1 to 14 and 16 to 19 and Comparative Examples 2 to 9.

In Exemplary Embodiment 15, the surface layer member 11 was formed of a fluororubber (SIFEL3405, manufactured by Shin-Etsu Chemical Co., Ltd.) and had a thickness of 0.3 mm.

In Comparative Example 1, the surface layer member 11 was formed of a silicone rubber and had a smooth surface without protruding structures. The smooth surface had an arithmetic average roughness Ra of 0.001 μm.

In all the exemplary embodiments and Comparative Examples 2 to 9, the surface layer member 11 had protruding structures (the same protruding structures at regular intervals) having the dimensions listed in Table 1 on the surface thereof. The protruding structures were arranged in an array of triangles in Exemplary Embodiments 3, 9, and 15 and in an array of squares in the other exemplary embodiments and comparative examples. Table 1 listed the characteristics of the intermediate transfer members used in the exemplary embodiments and comparative examples. In Table 1, "R" denotes the average ratio of surface areas of the intermediate transfer member to a unit area of the surface of the intermediate transfer member, and "S" denotes the average ratio of the total surface area of upper portions of the protruding structures to a unit area of the surface of the intermediate transfer member. The dimensions of the protruding structures in the exemplary embodiments were measured with a scanning probe microscope (SPM, manufactured by Hitachi High-Tech Science Corporation) and a scanning electron microscope (SEM, manufactured by Hitachi High-Technologies Corporation). In some of the exemplary embodiments, the protruding structures were formed from anodized porous alumina under specific conditions. In the other exemplary embodiments, the protruding structures were formed on a silicon wafer by photolithography and etching and were transferred to an intermediate transfer member.

TABLE 1

| | Shape | Height [μm] | Width [μm] | Intervals [μm] | R [—] | S [—] | 1/24 · (10R − 13) [—] | Static contact angle of water on smooth surface [degree] | Static contact angle of reaction liquid on smooth surface [degree] |
|---|---|---|---|---|---|---|---|---|---|
| Exemplary embodiment 1 | Quadrangular prism | 0.6 | 0.4 | 0.8 | 1.52 | 0.09 | 0.09 | 110 | 35 |
| Exemplary embodiment 2 | Quadrangular prism | 0.4 | 0.4 | 0.4 | 1.79 | 0.20 | 0.20 | 110 | 35 |
| Exemplary embodiment 3 | Quadrangular prism | 0.4 | 0.4 | 0.3 | 2.03 | 0.26 | 0.30 | 110 | 35 |
| Exemplary embodiment 4 | Quadrangular prism | 0.4 | 0.4 | 0.2 | 2.40 | 0.35 | 0.46 | 110 | 35 |
| Exemplary embodiment 5 | Quadrangular prism | 0.4 | 0.3 | 0.3 | 2.05 | 0.20 | 0.31 | 110 | 35 |
| Exemplary embodiment 6 | Quadrangular prism | 0.4 | 0.3 | 0.2 | 2.51 | 0.29 | 0.50 | 110 | 35 |
| Exemplary embodiment 7 | Quadrangular prism | 0.4 | 0.2 | 0.3 | 2.01 | 0.13 | 0.30 | 110 | 35 |
| Exemplary embodiment 8 | Quadrangular pyramid | 0.7 | 1.0 | 0.6 | 1.30 | 0.00 | 0.00 | 110 | 35 |
| Exemplary embodiment 9 | Quadrangular pyramid | 0.7 | 1.0 | 0.5 | 1.32 | 0.00 | 0.01 | 110 | 35 |
| Exemplary embodiment 10 | Quadrangular pyramid | 0.7 | 1.0 | 0.3 | 1.43 | 0.00 | 0.05 | 110 | 35 |
| Exemplary embodiment 11 | Quadrangular pyramid | 0.7 | 1.0 | 0.15 | 1.55 | 0.00 | 0.10 | 110 | 35 |
| Exemplary embodiment 12 | Quadrangular pyramid | 0.5 | 0.7 | 0.3 | 1.36 | 0.00 | 0.03 | 110 | 35 |
| Exemplary embodiment 13 | Quadrangular pyramid | 0.5 | 0.7 | 0.15 | 1.50 | 0.00 | 0.08 | 110 | 35 |
| Exemplary embodiment 14 | Quadrangular pyramid | 0.25 | 0.35 | 0.2 | 1.30 | 0.00 | 0.00 | 110 | 35 |
| Exemplary embodiment 15 | Quadrangular pyramid | 0.7 | 1.0 | 0.2 | 1.51 | 0.00 | 0.09 | 110 | 35 |
| Exemplary embodiment 16 | Quadrangular pyramid | 1.4 | 2.0 | 0.5 | 1.50 | 0.00 | 0.07 | 110 | 35 |
| Exemplary embodiment 17 | Moth-eye | 0.3 | 0.4 | 0.3 | 1.86 | 0.18 | 0.23 | 110 | 35 |
| Exemplary embodiment 18 | Frustum | 0.7 | 0.2 | 1 | 1.72 | 0.03 | 0.18 | 110 | 35 |
| Exemplary embodiment 19 | Quadrangular prism + pyramid | 0.6 | 0.7 | 0.2 | 1.79 | 0.00 | 0.20 | 110 | 35 |
| Comparative example 1 | — | 0 | 0 | 0 | 1.00 | 1.00 | −0.13 | 110 | 35 |
| Comparative example 2 | Quadrangular prism | 0.6 | 0.8 | 0.8 | 1.59 | 0.20 | 0.12 | 110 | 35 |
| Comparative example 3 | Quadrangular prism | 0.6 | 0.8 | 0.4 | 2.05 | 0.35 | 0.31 | 110 | 35 |
| Comparative example 4 | Quadrangular prism | 0.4 | 0.8 | 0.8 | 1.39 | 0.20 | 0.04 | 110 | 35 |
| Comparative example 5 | Quadrangular prism | 0.4 | 0.8 | 0.4 | 1.70 | 0.35 | 0.17 | 110 | 35 |
| Comparative example 6 | Quadrangular prism | 0.4 | 0.5 | 0.3 | 1.98 | 0.31 | 0.28 | 110 | 35 |
| Comparative example 7 | Quadrangular prism | 0.4 | 0.4 | 0.8 | 1.35 | 0.09 | 0.02 | 110 | 35 |
| Comparative example 8 | Quadrangular prism | 0.4 | 0.4 | 0.6 | 1.50 | 0.13 | 0.08 | 110 | 35 |
| Comparative example 9 | Quadrangular prism | 0.4 | 0.4 | 0.5 | 1.62 | 0.16 | 0.13 | 110 | 35 |

In the exemplary embodiments and comparative examples, a PET film (thickness: 150 μm) subjected to surface hydrophilic treatment was used as a recording medium 18. Before an intermediate image is transferred, an ink on the surface of the intermediate transfer member reacts with a reaction liquid and has increased viscosity, and liquid components of the ink are evaporated. Thus, even when the recording medium 18 of very low ink absorbency, such as a PET film, is used, the intermediate image can be transferred to the recording medium. Although the recording medium 18 was a long rolled sheet, a cut sheet having a prescribed shape may also be used.

A reaction liquid and an ink used in the exemplary embodiments and comparative examples were prepared as described below.

Preparation of Reaction Liquid

A reaction liquid was prepared by mixing the following components while stirring and passing the mixture under pressure through a microfilter having a pore size of 3.0 μm (manufactured by Fujifilm Corporation).

| | |
|---|---|
| Glutaric acid | 55 parts |
| 8N aqueous potassium hydroxide | 20 parts |
| Glycerin | 5 parts |
| Surfactant (F444, DIC Corporation) | 10 parts |
| Ion-exchanged water | 10 parts |

Preparation of Ink

First, pigment dispersion liquids and polymer particle dispersions were prepared as described below.

(1) Preparation of Black Pigment Dispersion Liquid

The following were mixed: 10 parts of carbon black (product name: Monarch 1100, manufactured by Cabot Corporation), 15 parts of an aqueous pigment dispersant (a styrene-ethyl acrylate-acrylic acid copolymer, acid value: 150, weight-average molecular weight: 8,000, solid content: 20%, neutralized with potassium hydroxide), and 75 parts of pure water. This mixture was dispersed with 200 parts of zirconia beads having a diameter of 0.3 mm in a batch type vertical sand mill (manufactured by AIMEX Co., Ltd.) for 5 hours while cooling with water. The dispersion liquid was centrifuged with a centrifugal separator to remove coarse particles, thus producing a black pigment dispersion liquid having a pigment concentration of approximately 10%.

(2) Preparation of Cyan Pigment Dispersion Liquid

A cyan pigment dispersion liquid was prepared in the same manner as in the preparation of the black pigment dispersion liquid except that 10 parts of carbon black was replaced with 10 parts of C.I. Pigment Blue 15:3.

(3) Preparation of Magenta Pigment Dispersion Liquid

A magenta pigment dispersion liquid was prepared in the same manner as in the preparation of the black pigment dispersion liquid except that 10 parts of carbon black was replaced with 10 parts of C.I. Pigment Red 122.

(4) Preparation of Yellow Pigment Dispersion Liquid

A yellow pigment dispersion liquid was prepared in the same manner as in the preparation of the black pigment dispersion liquid except that 10 parts of carbon black was replaced with 10 parts of C.I. Pigment Yellow 74.

(5) Preparation of Polymer Particle Dispersion 18 parts of butyl methacrylate, 2 parts of 2,2'-azobis-(2-methylbutyronitrile), and 2 parts of n-hexadecane were mixed for 0.5 hours. The mixture was added dropwise to 78 parts of a 6% aqueous solution of an emulsifying agent composed of a styrene-acrylic acid copolymer (acid value: 120 mgKOH/g, weight-average molecular weight: 8,700). The mixture was stirred for 0.5 hours. The mixture was then irradiated with ultrasonic waves for 3 hours using an ultrasonic irradiation apparatus. The mixture was then subjected to a polymerization reaction in a nitrogen atmosphere at 80#dC for 4 hours, was cooled to room temperature, and was filtered, thus producing an approximately 20% polymer particle dispersion. The polymer particles had a weight-average molecular weight of approximately 200,000 and a dispersion particle size of approximately 250 nm.

Black, cyan, magenta, and yellow inks having the following composition were prepared. More specifically, the inks were prepared by mixing the following components while stirring and passing the mixture under pressure through a microfilter having a pore size of 3.0 μm (manufactured by Fujifilm Corporation).

| | |
|---|---|
| Pigment dispersion liquid of each color prepared as described above (concentration: approximately 10%) | 20 parts |
| Polymer particle dispersion prepared as described above (concentration: approximately 20%) | 20 parts |
| Glycerin | 5 parts |
| Diethylene glycol | 5 parts |
| Surfactant (Acetylenol EH) | 1 part |
| Ion-exchanged water | 45 parts |

Image-Recording Method

Image recording was performed with the apparatus illustrated in FIG. 1, as described below. A reaction liquid was applied to the surface of the intermediate transfer member with a roller application device 14 while the intermediate transfer member was rotated in the direction of the arrow in FIG. 1. The application amount of the reaction liquid was 1.0 $g/m^2$. An ink was then ejected on the surface of the intermediate transfer member from an ink jet device 15. The ink reacted with the reaction liquid on the surface of the intermediate transfer member and formed an intermediate image. After the intermediate image was formed, water in the intermediate image was removed with a blower 16 and a heater 17, which was disposed within the supporting member 12 of the intermediate transfer member. With the rotation of the intermediate transfer member, the intermediate image passed between the intermediate transfer member and a pressure roller 19. The intermediate image on the intermediate transfer member was transferred to the recording medium 18 by pressure bonding. After the intermediate image was transferred, the surface of the intermediate transfer member was cleaned with a cleaning unit 20. This image recording operation was continuously performed while the intermediate transfer member was rotated. Image recording according to Exemplary Embodiments 1 to 19 and Comparative Examples 1 to 9 was performed by the image-recording method using the image-recording apparatus illustrated in FIG. 1. For each final image thus formed, reaction liquid applicability and transferability were evaluated as described below. Reaction liquid applicability was evaluated with respect to the coverage of the surface of the intermediate transfer member with the reaction liquid layer. Uniformity of the reaction liquid layer on the surface of the intermediate transfer member was evaluated with respect to the percentage of a uniform portion of the reaction liquid layer. Transferability was evaluated with respect to the transfer rate to the recording medium.

The coverage with the reaction liquid layer, the uniformity of the reaction liquid layer, and the transfer rate were measured as described below.

The coverage with the reaction liquid layer was calculated by observing the surface of the intermediate transfer member to which the reaction liquid was applied with an optical microscope and determining the ratio of (the area of the reaction liquid)/(the surface area of the intermediate transfer member). The surface area of the intermediate transfer member is the area observed with the optical microscope without consideration of the surface profile.

In the optical microscope observation of the surface of the intermediate transfer member to which the reaction liquid was applied, there is no interface of the reaction liquid layer or no interference fringe in a uniform area of the reaction liquid layer, whereas there is an interface of the reaction liquid layer or interference fringes in a nonuniform area of the reaction liquid layer. Thus, the degree of uniformity of the reaction liquid layer was determined by (the uniform area of the reaction liquid determined as described above)/(the surface area of the intermediate transfer member). The surface area of the intermediate transfer member was calculated in the same manner as in the calculation of the coverage.

The transfer rate was measured by observing the intermediate transfer member with an optical microscope after the transferring process, calculating the remaining area of the intermediate image, and calculating [100−(the remaining area of the intermediate image)/(the area of the intermediate image)].

Image reproducibility was examined in sensory evaluation of a final image by a plurality of testers after the image recording process was performed 10,000 times using the same intermediate transfer member.

Evaluation Criteria for Coverage with Reaction Liquid Layer

AA: The coverage of the surface of the intermediate transfer member with the reaction liquid layer was 95% or more.

A: The coverage of the surface of the intermediate transfer member with the reaction liquid layer was 90% or more and less than 95%.

B: The coverage of the surface of the intermediate transfer member with the reaction liquid layer was 80% or more and less than 90%.

C: The coverage of the surface of the intermediate transfer member with the reaction liquid layer was less than 80%.

Evaluation Criteria for Uniformity of Reaction Liquid Layer

AA: The degree of uniformity of the reaction liquid layer on the surface of the intermediate transfer member was 95% or more.

A: The degree of uniformity of the reaction liquid layer on the surface of the intermediate transfer member was 90% or more and less than 95%.

B: The degree of uniformity of the reaction liquid layer on the surface of the intermediate transfer member was 80% or more and less than 90%.

C: The degree of uniformity of the reaction liquid layer on the surface of the intermediate transfer member was less than 80%.

Evaluation Criteria for Transferability

AA: The transfer rate of an intermediate image to the recording medium was 95% or more.

A: The transfer rate of an intermediate image to the recording medium was 90% or more and less than 95%.

B: The transfer rate of an intermediate image to the recording medium was 80% or more and less than 90%.

C: The transfer rate of an intermediate image to the recording medium was less than 80%.

Evaluation Criteria for Image Reproducibility

AA: 90% or more of the testers judged that reproducibility was good.

A: 80% or more and less than 90% of the testers judged that reproducibility was good.

B: 50% or more and less than 80% of the testers judged that reproducibility was good.

C: Less than 50% of the testers judged that reproducibility was good.

Table 2 shows the results.

TABLE 2

| | Coverage with reaction liquid layer | Uniformity of reaction liquid layer | Transfer-ability | Image reproduc-ibility |
|---|---|---|---|---|
| Exemplary embodiment 1 | AA | AA | AA | A |
| Exemplary embodiment 2 | AA | AA | AA | A |
| Exemplary embodiment 3 | AA | AA | AA | A |
| Exemplary embodiment 4 | AA | AA | AA | A |
| Exemplary embodiment 5 | AA | AA | AA | A |
| Exemplary embodiment 6 | AA | AA | AA | A |
| Exemplary embodiment 7 | AA | AA | AA | A |
| Exemplary embodiment 8 | AA | AA | AA | AA |
| Exemplary embodiment 9 | AA | AA | AA | AA |
| Exemplary embodiment 10 | AA | AA | AA | AA |
| Exemplary embodiment 11 | AA | AA | AA | AA |
| Exemplary embodiment 12 | AA | AA | AA | AA |
| Exemplary embodiment 13 | AA | AA | AA | AA |
| Exemplary embodiment 14 | AA | AA | AA | AA |
| Exemplary embodiment 15 | AA | AA | AA | AA |
| Exemplary embodiment 16 | AA | AA | A | A |
| Exemplary embodiment 17 | AA | AA | AA | AA |
| Exemplary embodiment 18 | AA | AA | AA | AA |
| Exemplary embodiment 19 | AA | AA | AA | AA |
| Comparative example 1 | C | C | A | C |
| Comparative example 2 | AA | B | AA | C |
| Comparative example 3 | AA | B | AA | C |
| Comparative example 4 | AA | B | AA | B |
| Comparative example 5 | AA | B | AA | C |
| Comparative example 6 | AA | A | AA | B |
| Comparative example 7 | AA | B | AA | B |
| Comparative example 8 | AA | B | AA | B |
| Comparative example 9 | AA | A | AA | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-085288 filed Apr. 17, 2014, which is hereby incorporated by reference herein in its entirety.

What is claimed is:

1. An intermediate transfer member for use in an image-recording method that comprises a process for applying a reaction liquid to an intermediate transfer member, a process for forming an intermediate image by applying an ink to the intermediate transfer member to which the reaction liquid has been applied, and a process for transferring the intermediate image to a recording medium, wherein the intermediate transfer member has protruding structures having an average height of 3.0 μm or less on a surface thereof, and an average ratio R of surface areas of the intermediate transfer member to a unit area of a surface of the intermediate transfer member and an average ratio S of a total surface area of upper portions of the protruding structures to a unit area of the surface of the intermediate transfer member satisfy the following formula (1):

$$S \leq \tfrac{1}{24} \cdot (10R - 13) \quad (1)$$

wherein R≥1.3, and 0≤S≤1.

2. The intermediate transfer member according to claim 1, wherein the protruding structures have the average height of 1.0 μm or less.

3. The intermediate transfer member according to claim 1, wherein the protruding structures have the shape of a pillar, cone, moth-eye, or frustum.

4. The intermediate transfer member according to claim 1, wherein the intermediate transfer member has a smooth surface having a static water contact angle of 90 degrees or more.

5. The intermediate transfer member according to claim 1, wherein the intermediate transfer member contains a fluorine or silicone compound on a surface thereof.

6. An image-recording apparatus comprising:

the intermediate transfer member according to claim 1;

a reaction liquid applying unit configured to apply a reaction liquid to the intermediate transfer member;

an ink applying unit configured to apply an ink to the intermediate transfer member and form an intermediate image; and a transferring unit configured to transfer the intermediate image to a recording medium.

7. An image-recording method comprising:

applying a reaction liquid to an intermediate transfer member;

forming an intermediate image by applying an ink to the intermediate transfer member to which the reaction liquid has been applied; and transferring the intermediate image to a recording medium, wherein the intermediate transfer member has protruding structures having an average height of 3.0 μm or less on a surface thereof, and wherein an average ratio R of surface areas of the intermediate transfer member to a unit area of a surface of the intermediate transfer member and an average ratio S of a total surface area of upper portions of the protruding structures to a unit area of the surface of the intermediate transfer member satisfy the following formula (1):

$$S \leq \tfrac{1}{24} \cdot (10R - 13) \quad (1)$$

wherein R≥1.3, and 0≤S≤1.

8. The image-recording method according to claim 7, wherein the protruding structures have the average height of 1.0 μm or less.

9. The image-recording method according to claim 7, wherein the reaction liquid has a static contact angle of 40 degrees or less on a smooth surface of the intermediate transfer member.

10. The image-recording method according to claim 7, wherein the reaction liquid contains a fluorinated surfactant, the fluorinated surfactant content being in the range of 1% to 15% by mass.

* * * * *